US005642637A

United States Patent [19]

Crum

[11] Patent Number: 5,642,637

[45] Date of Patent: Jul. 1, 1997

[54] LUBRICATOR ASSEMBLY FOR PRESSES USABLE IN DIE FORGING

[75] Inventor: James R. Crum, Clintonville, Wis.

[73] Assignee: Walker Forge Inc., Racine, Wis.

[21] Appl. No.: 655,978

[22] Filed: May 31, 1996

[51] Int. Cl.[6] ..... B21B 45/04; B21B 45/02; B21C 43/00

[52] U.S. Cl. ..... 72/43; 72/39

[58] Field of Search ..... 72/41, 43, 19.8, 72/20.1, 39; 74/105, 102, 110; 239/585.1

[56] References Cited

U.S. PATENT DOCUMENTS

| | | | |
|---|---|---|---|
| 3,263,515 | 8/1966 | Adamski | 74/105 |
| 3,263,516 | 8/1966 | Chisholm | 74/105 |
| 3,633,651 | 1/1972 | Ruhlandt | 164/267 |
| 3,948,467 | 4/1976 | Krusius | 74/110 |
| 4,520,643 | 6/1985 | Werner et al. | 72/39 |
| 4,631,945 | 12/1986 | Hulings et al. | 72/43 |
| 4,969,344 | 11/1990 | Hinterman et al. | 72/21.1 |
| 5,269,163 | 12/1993 | Yagi et al. | 72/20.1 |

OTHER PUBLICATIONS

Product Data Sheet for Dag Lubrimate Linear Reciprocator, Acheson Colloids Company, Port Huron, MI, 3 pages.

Die Lubrication and Automation Equipment for the Metal Forming Industry, Lubrimation, Inc., Columbus, OH, 5 pages.

*Primary Examiner*—Lowell A. Larson
*Assistant Examiner*—Rodney A. Butler
*Attorney, Agent, or Firm*—Nilles & Nilles, S.C.

[57] ABSTRACT

A reciprocating lubricator assembly for a die press employs a non-linear travel path and a mechanical advantage to permit the use of an actuator having a very short stroke to move a lubricating nozzle into and out of alignment with the dies, thereby permitting very rapid operation and increasing the press's production rate. The design of the lubricator assembly may depend upon the size of the press. Relatively small presses employing dies on the order of 6" can accommodate a lubricator assembly the nozzle of which is reciprocated by a glide arm assembly which causes the nozzle to move a stroke on the order of 5½–7" with a 3" actuator stroke. Larger presses having dies on the order of 14" or larger are better suited for accommodating a swing arm assembly the nozzle of which traverses a stroke of 10" or more with an actuator stroke of 3".

16 Claims, 10 Drawing Sheets

LUBRICATOR ASSEMBLY FOR PRESSES USABLE IN DIE FORGING

BACKGROUND OF THE INVENTION

1. Field of the Invention

The invention relates to a lubricator assembly for lubricating a press and, more particularly, to a reciprocating lubricator assembly for lubricating the dies of a die press usable in a forging operation.

2. Discussion of the Related Art

Die presses, sometimes called die forges, are well known for performing die forging metalworking operations. The typical die press includes a bolster having front and rear surfaces and a central opening. Disposed in the central opening are a first, stationary die and a second, movable die in axial alignment with the first die. A casting, sometimes called a forging, is pressed into a desired shape by placing it between the first and second dies and by driving the second die towards the first die under fluid or mechanical pressure to press the casting between the first and second dies and to deform it into the desired shape. The casting is heated in hot forging operations and unheated in cold forging operations. Typical forging operations performed by such presses are open-die forging, closed-die forging, and impression-die forging.

Virtually all forging operations require die lubrication. Applying a lubricant to the dies of a press at the appropriate time reduces friction, thereby 1) reducing die wear and 2) promoting the flow of metal into the die cavities. When used in a hot forging operation, a lubricant also serves as a thermal barrier between the hot casting and the relatively cool dies, thereby slowing the cooling rate of the casting. In addition, the lubricant serves as a parting agent, preventing the casting from sticking to the dies. A wide variety of lubricants can be used in hot forging including graphite, molybdenum disulfate, and sometimes glass. Mineral oils and soaps are commonly used in cold forging.

Lubricant can be applied to the dies either continuously from a stationary lubricator located outside of the press cavity or selectively from a reciprocating lubricator which is positioned outside of the press cavity when the press is closed and which, upon press opening, extends into the press cavity, lubricates the dies, and then retracts from the press cavity before the press closes. Reciprocating lubricators are preferred in many applications 1) because they are positionable to apply lubricant only where it is needed the most, i.e., to the dies, and 2) because they are cleaner than continuously-operating stationary lubricators because they apply lubricant only when it is required.

The most commonly available reciprocating lubricator is a so-called linearly-reciprocating lubricator having a nozzle mounted on the end of an arm which is in turn mounted on a rod of a piston and cylinder device. The arm moves linearly into and out of alignment with the dies upon cylinder extension or retraction. A disadvantage of this type of lubricator is that, because there is a one-to-one correlation between piston stroke and nozzle stroke, and because the linear path of the nozzle requires that it traverse a relatively large distance to move into and out of alignment with the dies, a relatively large cylinder is required. For example, the typical 14" die requires a cylinder stroke of 42" or more to effect the required linear reciprocation of the nozzle.

Marked disadvantageous arise from the requirement of a large cylinder to operate a reciprocating lubricator. For instance, lubricators requiring large cylinders are relatively large, expensive, and cumbersome. Moreover, and perhaps more importantly, the large cylinders required by the typical reciprocating lubricator assembly are relatively slow acting, requiring several seconds for a complete extension/retraction cycle. The lengthy lubrication cycle can significantly increase the length of a forging cycle and reduce a press's production rate.

OBJECTS AND SUMMARY OF THE INVENTION

A primary object of the invention therefore is to provide a non-linearly reciprocating lubricator assembly which is designed for lubricating the dies of a die press usable in a die forging operation and which employs a combination of a nonlinear nozzle stroke and a mechanical advantage to effect movement of a lubricating nozzle into and out of alignment with the dies of the press rapidly and with a very short actuator stroke.

A secondary object of the invention is to provide a lubricator assembly which meets the first primary object of the invention and which is relatively simple in construction and operation.

Another secondary object of the invention is to provide a lubricator assembly which meets the first primary object of the invention and which employs a simple and effective control assembly.

In accordance with a first aspect of the invention, the lubricator assembly includes a support frame, a movable lubricating arm assembly, a nozzle, and an actuator. The support frame is mountable on a bolster behind the first and second dies and includes mounting plates attached to the rear surface of the bolster on either side of the opening. The lubricating arm assembly is coupled to the support frame and is movable toward and away from the dies. The lubricating arm assembly includes a lube arm having a first end and having a second end. The nozzle is supported on the second end of the lube arm. The actuator has a first end pivotally attached to the support frame and a second end pivotally attached to the lubricating arm assembly. Upon extension of the actuator, the nozzle moves through an arc from a first position in which the nozzle is located behind the first and second dies to a second position in which the nozzle is positioned between the first and second dies.

Still another secondary objection of the invention is to provide a lubricator assembly which meets the first primary object Of the invention and which includes an improved valve assembly.

In accordance with yet another aspect of the invention, this object is achieved by providing at least three valves. The first, two-port/two position solenoid valve selectively and alternatively 1) couples the source of pressurized air to the atomizing air inlet port of the metering nozzle and 2) isolates the source of pressurized air from the atomizing air inlet port of the metering nozzle. The second, four-port/two position solenoid valve is operatively connected to the source of pressurized air, the cylinder, and vent. The second valve selectively and alternatively I) pressurizes the piston-side port of the cylinder while depressurizing the cylinder-side port of the cylinder, and 2) depressurizes the piston-side port of the cylinder while pressurizing the cylinder-side port of the cylinder. The third, three-port/two position solenoid valve is connected to the source of pressurized air, the pilot port of the metering nozzle, and vent. The third valve selectively and alternatively 1) couples the second inlet port of the metering nozzle to the source of pressurized air and 2) couples the second port of the metering nozzle to vent.

Still another secondary object of the invention is to provide a lubricator assembly which meets the first primary object of the invention and which is capable of supporting a second lubricator assembly.

In accordance with another aspect of the invention, this object is achieved by providing a mounting device on the lubricator assembly for supporting a second lubricating arm assembly.

A second primary object of the invention is to provide a lubricator assembly which meets the first primary object of the invention, which is usable with relatively large dies, and which employs a swing arm assembly to move the nozzle into and out of alignment with the dies.

In accordance with another aspect of the invention, this object is achieved by providing a support frame mountable on the rear surface of the bolster, a swing arm assembly, a lubricating nozzle, and a fluid pressure cylinder. The support frame includes a) mounting plates attached to the rear surface of the bolster on either side of the opening and b) a swing arm support which is supported on the support frame and which is located between the mounting plates. The swing arm assembly is mounted on the swing arm support so as to be pivotable about a horizontal axis. The swing arm assembly includes a support arm extending downwardly from the swing arm support, the support arm having a first end supported on the swing arm support and having a second end, and a lube arm extending forwardly from the first arm, the lube arm having a first end supported on the first arm and a second. The lubricating nozzle is supported on the second end of the lube arm. The fluid pressure cylinder has a first end pivotally attached to the support frame and a second end pivotally attached to the support arm at a location between the first and second ends thereof. Upon extension of the cylinder, the nozzle moves from a first position in which the nozzle is located behind the first and second dies and beneath an upper surface of the first die to a second position in which the nozzle is positioned vertically between the first and second dies.

A third primary object of the invention is to provide a lubricator which meets the first primary object of the invention, which is usable with relatively small dies, and which employs a glide arm assembly to move the nozzle into and out of alignment with the dies.

In accordance with yet another aspect of the invention, this object is achieved by providing a support frame mountable on the bolster behind the dies, a glide arm assembly, a lubricating nozzle, and a fluid pressure cylinder. The support frame includes mounting plates attached to the rear surface of the bolster on either side of the opening. The glide arm assembly is coupled to the support frame and is movable toward and away from the dies. The glide arm assembly includes a first bar mounted on the bolster behind the first and second dies, a second bar extending in parallel with the first bar, a third bar having a first end pivotally attached to the first bar and a second end pivotally attached to the second bar, and a lube arm having a first end mounted on the second bar and having a second end located in front of the second bar. The nozzle is supported on the second end of the lube arm. The fluid pressure cylinder has a first end pivotally attached to the support frame and a second end pivotally attached to the third arm of the glide arm assembly. Upon extension of the cylinder, the nozzle moves through an arc from a first position in which the nozzle is located behind the first and second dies to a second position in which the nozzle is positioned between the first and second dies.

These and other objects, features, and advantageous of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Figure 1:
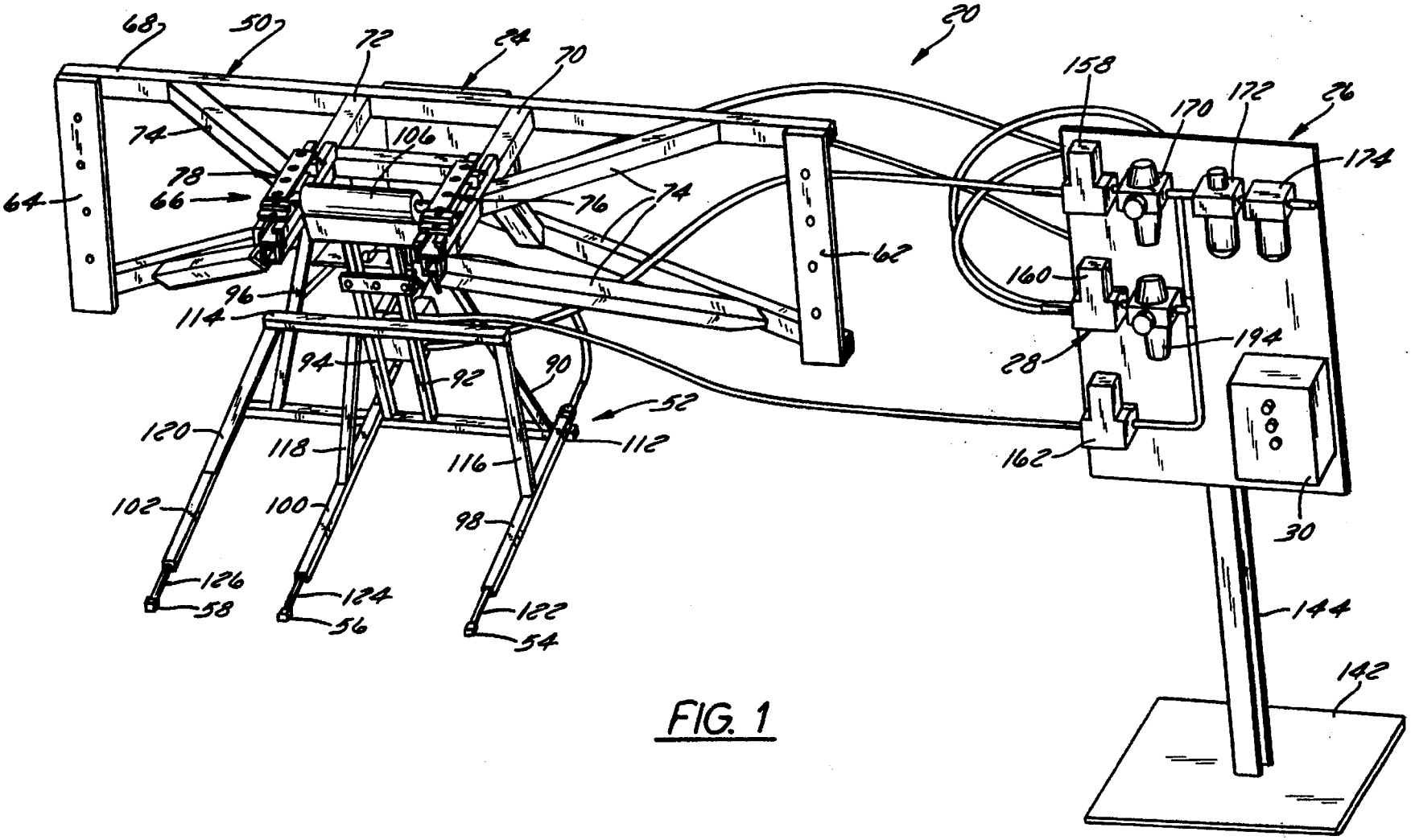
FIG. 1 is a perspective view of a lubricator assembly constructed in accordance with a first preferred embodiment of the invention.
Figure 2:
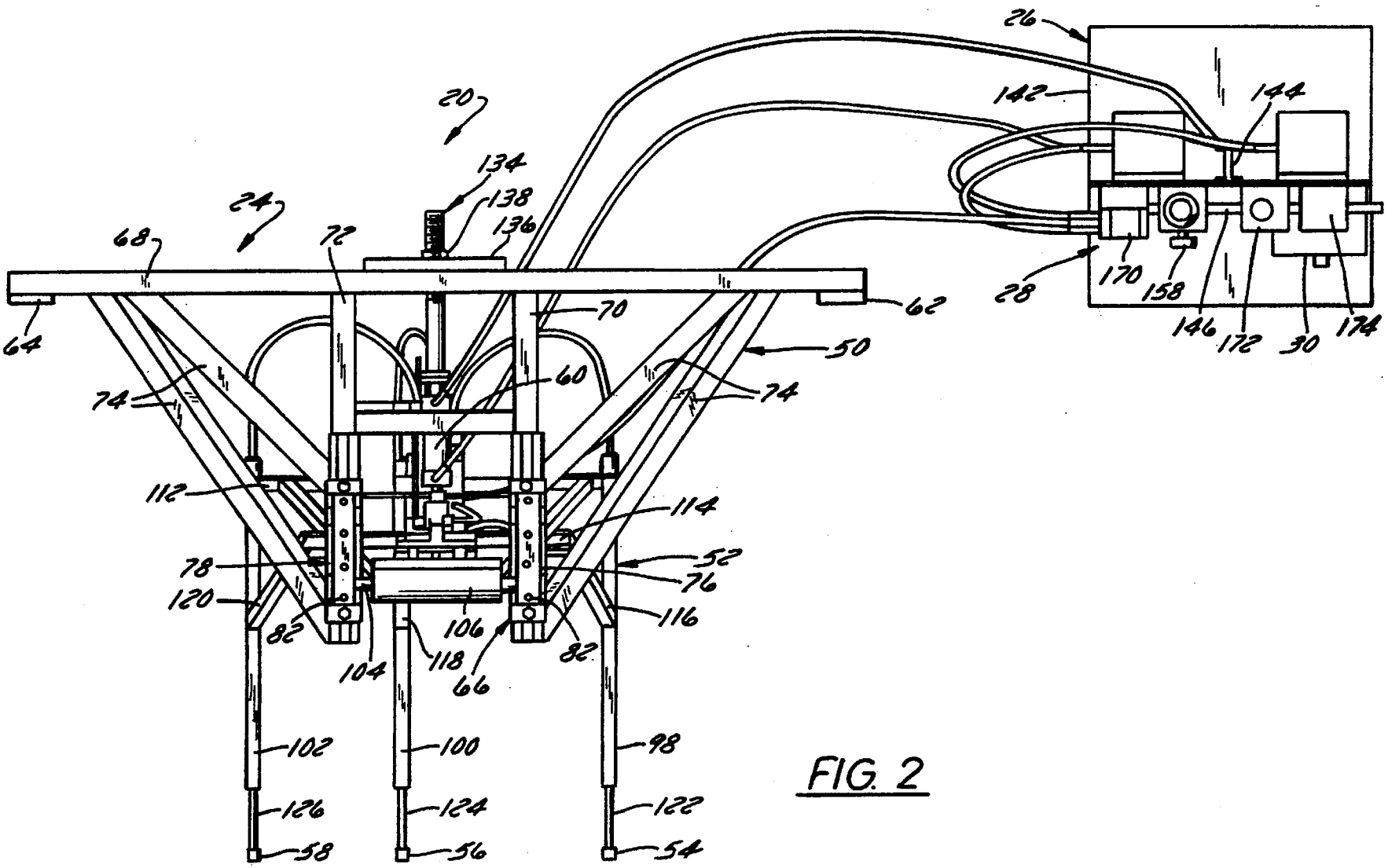
FIG. 2 is a top plan view of the lubricator assembly of FIG. 1.

Pursuant to the invention, a lubricator assembly is provided which is designed to selectively lubricate the dies of a die press usable in forging. The lubricator assembly employs a non-linear travel path and a mechanical advantage to permit the use of an actuator having a very short stroke to move a lubricating nozzle into and out of alignment with the dies, thereby permitting very rapid operation and increasing the press's production rate. The design of the lubricator assembly will depend in part upon the size of the press. For instance, relatively small presses employing dies on the order of 6" can accommodate a lubricator assembly the nozzle of which is reciprocated by a glide arm assembly which causes the nozzle to move a stroke on the order of 5½–7" with a 3" actuator stroke. Larger presses having dies on the order of 14" or larger are better suited for accommodating a swing arm assembly the nozzle of which traverses a stroke of 10" or more with an actuator stroke of 3". Two or more lubricator assemblies can also be used in conjunction with one another with one lubricator assembly being mounted on the other. Preferred control and valve assemblies of the lubricator assembly are also disclosed.

2. Construction of First Embodiment

Referring now to the drawings and initially to FIGS. 1–5, a reciprocating lubricator assembly 20 is illustrated which is well-suited for use with a relatively large die press 22. The illustrated lubricator assembly 20 includes a lubricator 24 and a control stand 26. Mounted on the control stand 26 are a pneumatic control valve assembly 28 and an electronic controller 30.

Figure 3:
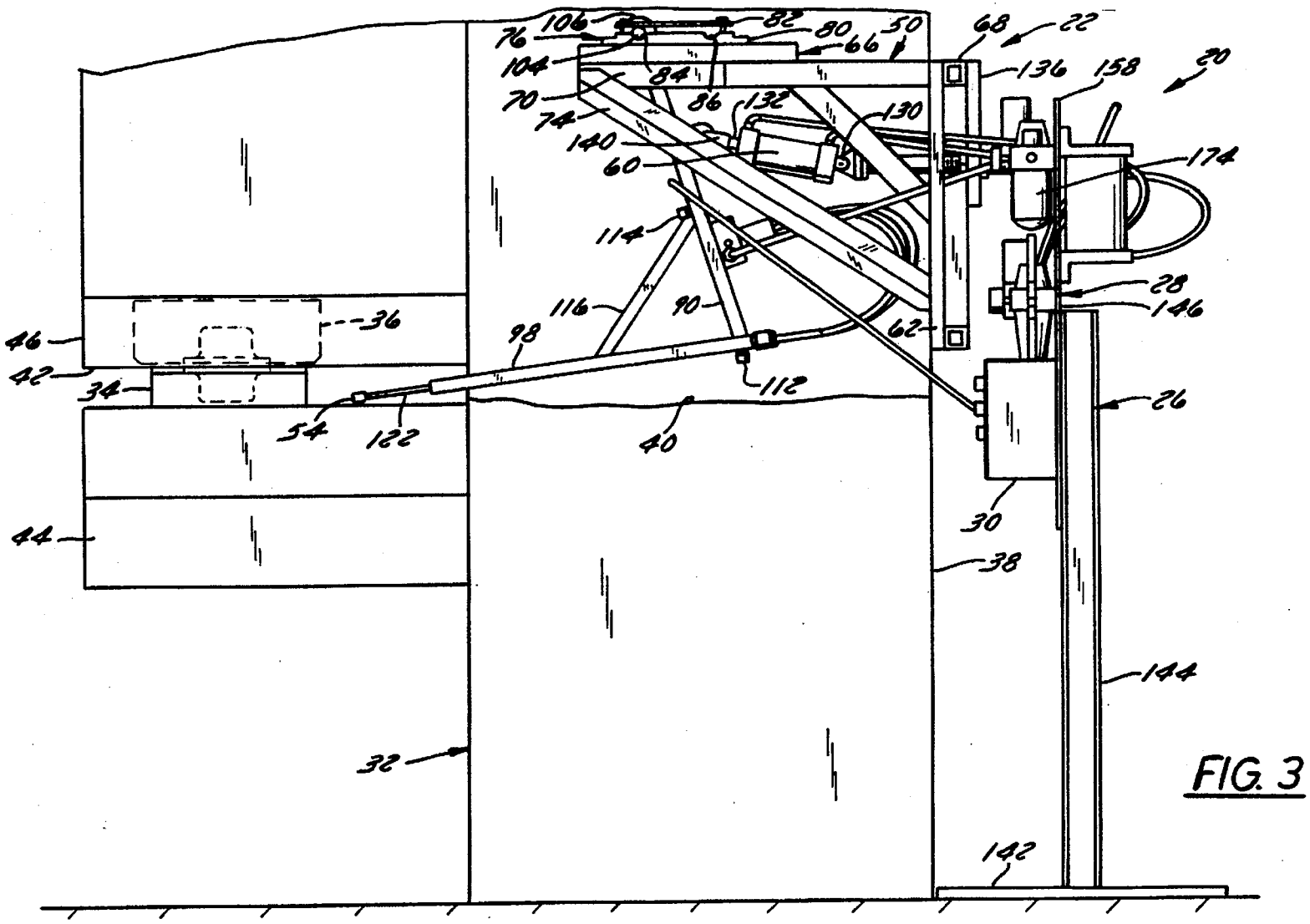
FIG. 3 is a side elevation view of a lubricator of the assembly of FIGS. 1 and 2 and of the cooperating portions of a die press with which the lubricator assembly is usable and illustrating the lubricator in a retracted and non-lubricating position.
Figure 4:
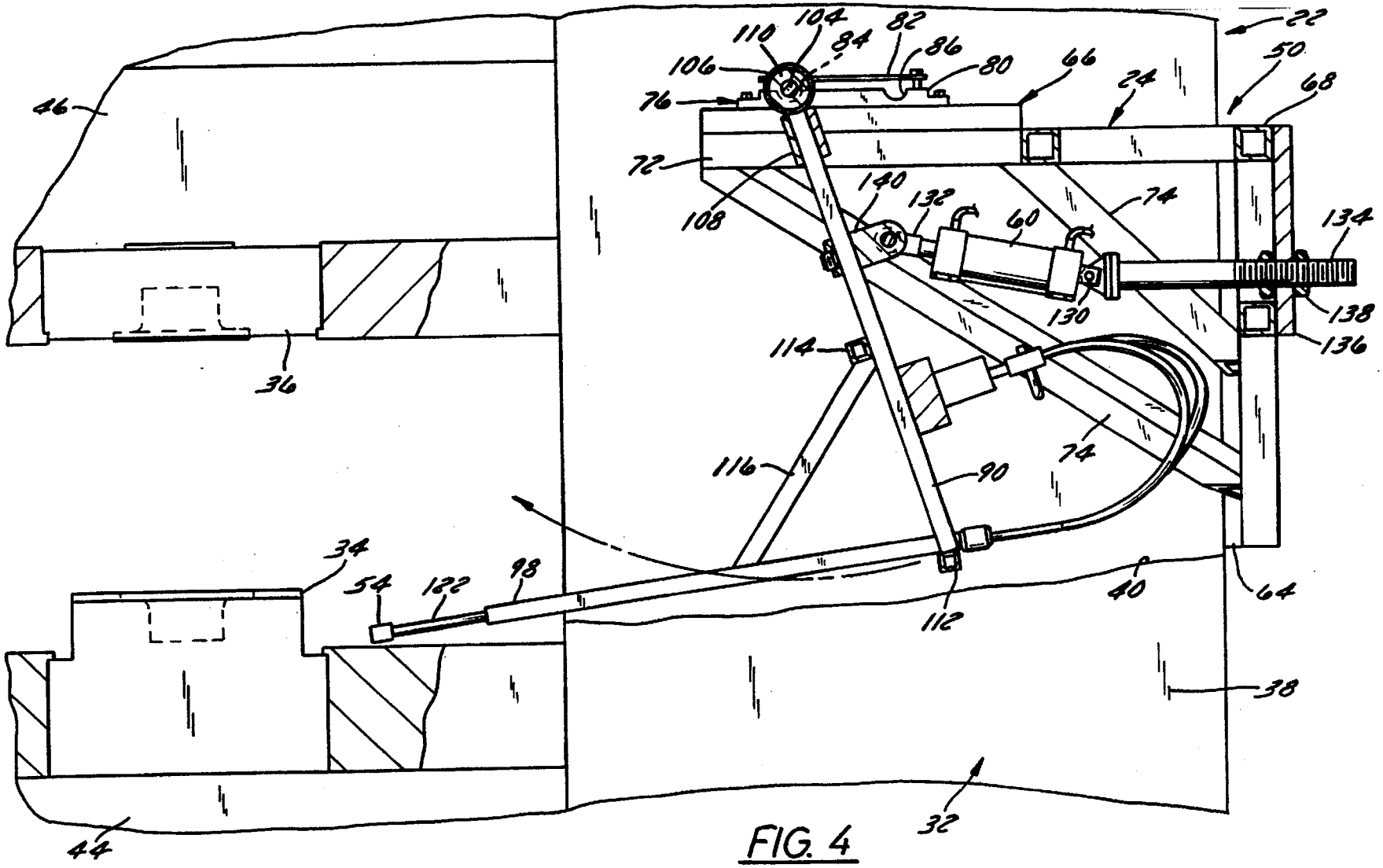
FIG. 4 is a sectional side elevation view of the lubricator and press of FIGS. 1–3, illustrating the lubricator in its retracted and non-lubricating position.
Figure 5:
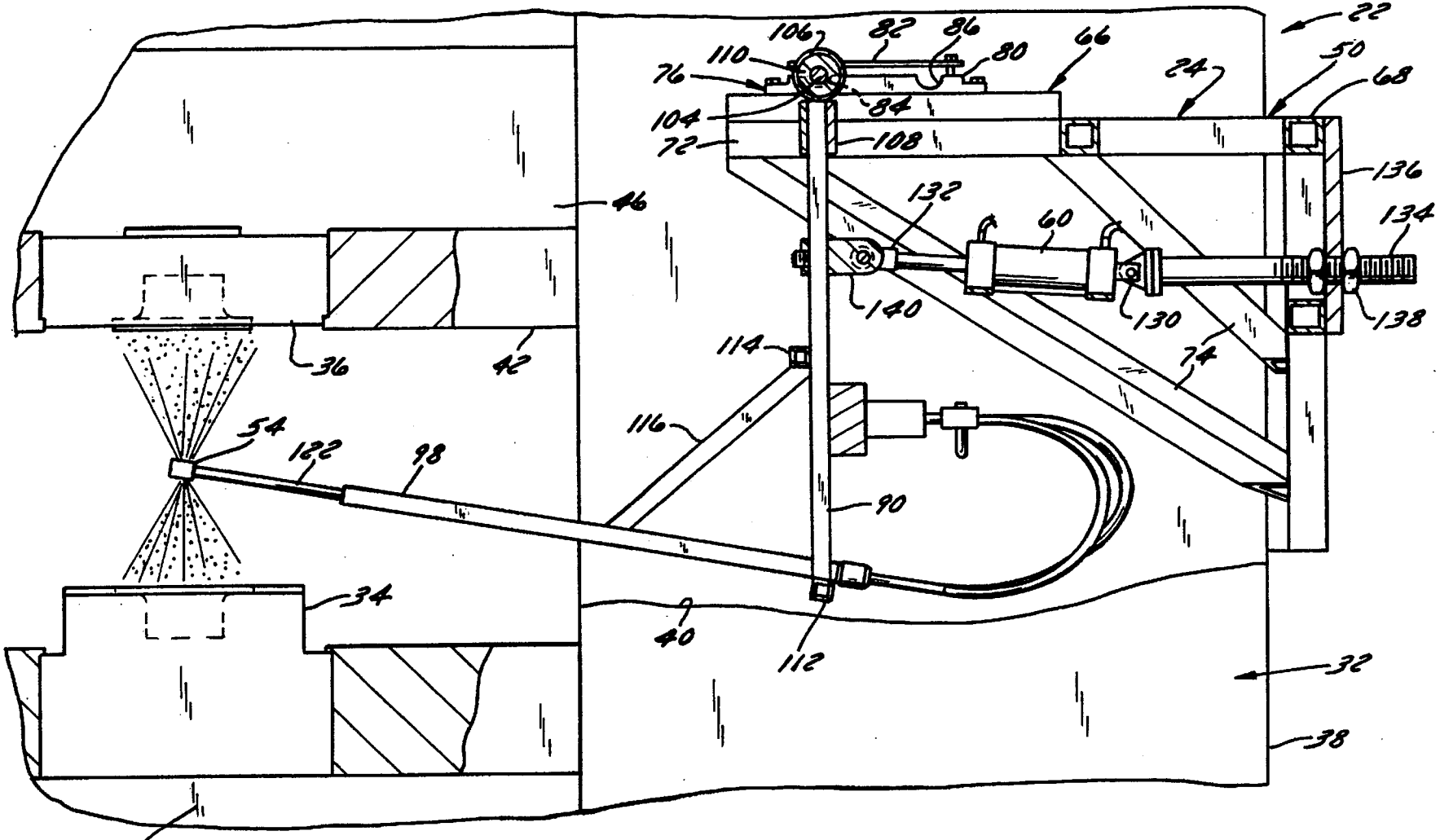
FIG. 5 is a side sectional elevation view corresponding to FIG. 4 and illustrating the lubricator in an extended and lubricating position.

As best seen in FIGS. 3–5, the illustrated die press 22 is a conventional 14" die press usable in a hot forging operation. The press 22 includes a bolster 32 and a die assembly 34, 36. The bolster 32 includes a rear surface 38 having an opening 40 formed therein which presents a press cavity 42 located in front of a front surface of the opening 40. Upper and lower surfaces of the press cavity 42 are defined by a lower support 44 and an upper support 46, respectively. The die assembly includes a first, upwardly-facing stationary die 34 mounted on the lower support 44 and a second, downwardly facing die 36 mounted on the upper support 46 in vertical alignment with the first die 34. The upper die 36 is coupled to a crank arm or some other mechanical or fluid-pressure actuator assembly (not shown) so as to be vertically movable 1) from a first position, illustrated in FIGS. 3 and 5, in which the second die 36 is spaced from the first die 34 2) to a second position, illustrated in FIG. 4, in which the second die 36 is positioned closely adjacent the first die 34 to effect a forging operation.

The lubricator 24 is designed to move at least one nozzle 1) from a first position, illustrated in FIGS. 3 and 4, in which it is positioned behind the dies 34, 36 2) to a second position, illustrated in FIG. 5, in which it is positioned between and in alignment with the dies 34 and 36. The illustrated lubricator 24 is a swing arm lubricator having a support frame 50, a moveable lubricator arm assembly 52, at least one lubricating nozzles 54, 56, or 58, and an actuator 60.

The support frame 50 is mounted on the bolster 32 behind the dies 34 and 36. In the illustrated embodiment, the support frame 50 includes mounting plates 62, 64 bolted or otherwise attached to the rear surface 38 of the bolster 32 on either side of the opening 40, and a swing arm support including a horizontal shaft holder 66 and a frame assembly supports the shaft holder 66 on the mounting plates 62, 64. The frame assembly for the shaft holder 66 includes 1) a horizontal lateral brace 68 connected to the upper ends of the plates 62, 64, 2) a pair of laterally spaced horizontal braces 70, 72 extending forwardly from the lateral brace 68 into the opening 40, and 3) a plurality of angle braces 74 extending from the horizontal braces 70, 72 to other portions of the frame assembly. The shaft holder 66 is formed from opposed pairs of clamps 76, 78, each of which comprises a lower shaft support bar 80 and an upper clamp bar 82 bolted to the lower bar 80. A groove 84 is formed in the upper surface of each of the lower bars 80 for reasons detailed below. Preferably, a second groove 86 is formed in each of the lower bars 80 for receiving a second lubricator assembly also as detailed below.

The lubricating arm assembly 52 comprises a swing arm assembly which includes 1) a pivot shaft assembly, 2) one and preferably several support arms 90, 92, 94 and 96, and 3) one and preferably several lube arms 98, 100, and 102. A support shaft 104 is supported in the grooves 84 in the lower bars 80 and is held in place by the upper bars 82. A sleeve 106 surrounds the shaft 104 and is held in axial alignment with the shaft 104 by a bushing 110 disposed between the shaft 104 and the sleeve 106. A mounting bracket 108 is fixed to and extends downwardly from the sleeve 106.

The support arms 90, 92, 94, and 96 are attached to the sleeve 106 by the mounting bracket 108 so as to extend in a common plane which also contains the support shaft 104. The longitudinal length of this plane will vary from application to application and will typically be of the order of 27" to 28". Each of the support arms 90, 92, 94, and 96 has a first end fixed to the mounting bracket 108 and a second end disposed below the first end. In the illustrated embodiment, the center two support arms 92 and 94 extend perpendicularly to the support shaft 104, and the two outer arms 90 and 96 extend laterally outwardly from the support shaft 104 at an angle. A spray bar 112 is attached to the lower or second ends of the support arms 90, 92, 94, and 96 so as to extend laterally across the lubricator 24.

A plurality (3 in the illustrated embodiment) of lube arms 98, 100, 102 are provided, each of which has a first end attached to the spray bar 112 and a second end disposed forwardly of the first end and spray bar. The lube arms 98, 100, and 102 are additionally supported by a lube arm support frame comprising 1) an upper brace 114 extending transversely across the support arms 90, 92, 94, and 96 and 2) angle braces 116, 118 and 120 each of which extends at an angle from the upper brace 114 to one of the respective lube arms 98, 100 and 102. Each of the lube arms 98, 100, and 102 preferably comprises a tube receiving a nozzle support tube 122, 124, or 126. A nozzle 54, 56, or 58 is mounted on the end of each of the support tubes 122, 124, or 126.

The angle between the support arms 90, 92, 94 and 96 and the plane containing lube arms 98, 100, and 102, as well as the relative lengths of the support arms and lube arms, are set to achieve the desired travel to lift ratio of the nozzles 54, 56, and 58 during system operation. In the illustrated embodiment, the angle is set at 80°, and the length from the spray bar 112 to the second end of the of the lube arms 98, 100, 102 can be varied from between 33"–39" by changing their position on the spray bar 112. In the illustrated example, this length is set to be about 36".

The actuator 60 preferably comprises a pneumatic cylinder having a first or cylinder end 130 and a second or rod end 132. The first end 130 is pivotably attached to a rod 134 which is in turn mounted on a support plate 136 of the support frame 50 by a lock nut assembly 138. The second or piston end 132 of the cylinder 60 is pivotably coupled to the support arm assembly by an I-bracket 140. I-bracket 140 is mounted on the center two support arms 92, 94 so as to be movable longitudinally therealong so that it can be spaced anywhere from 12" to 18" from the shaft 104, thereby to adjust the stroke of the lubricator 24 with a given stroke of the cylinder 60.

Figure 6:
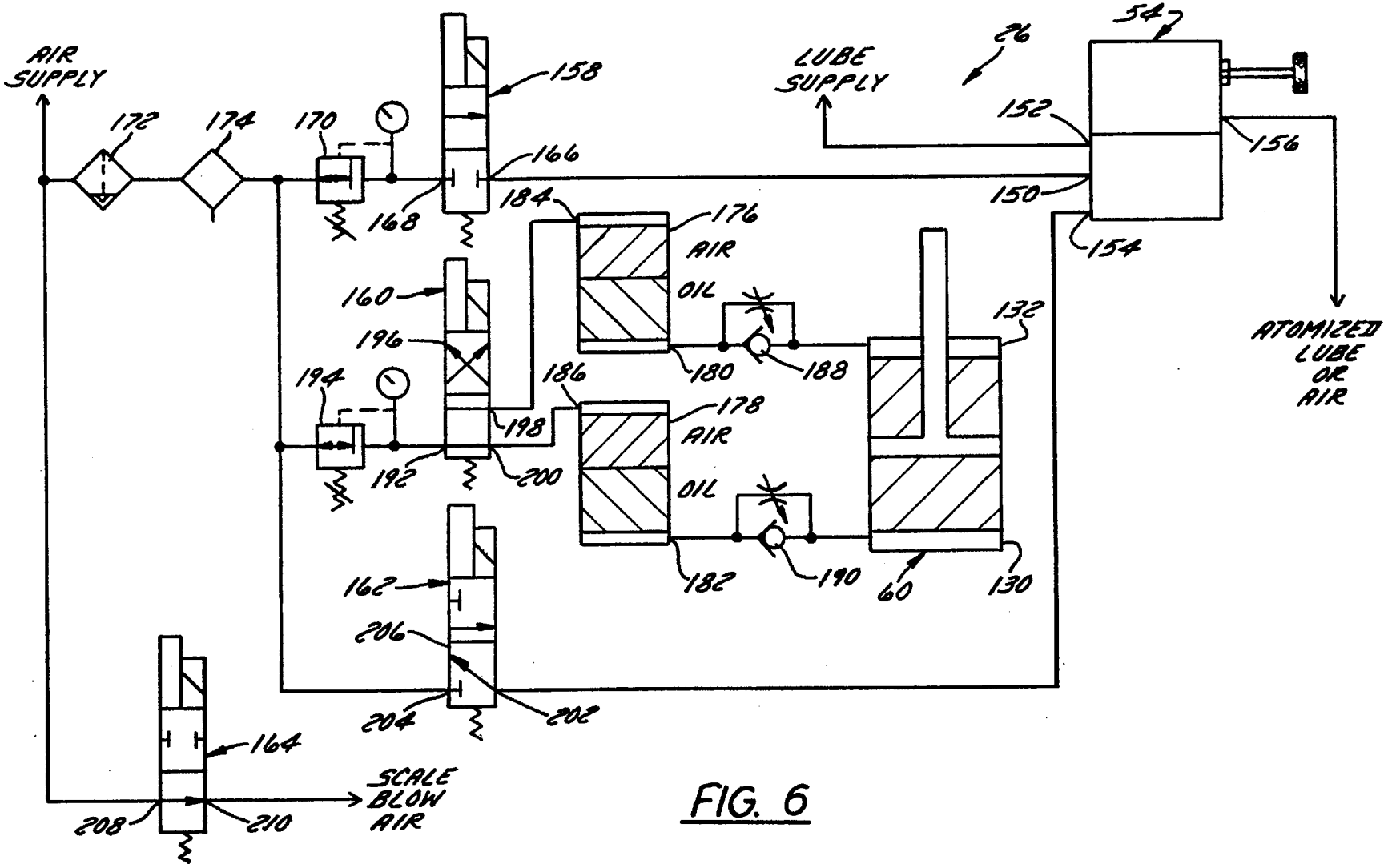
FIG. 6 schematically represents a fluid pressure control circuit for the lubricator assembly of FIGS. 1–5.

Each of the nozzles 54, 56, and 58 comprises a pilot actuated metering nozzle controlled by the valve assembly 28. Each of the nozzles is of identical construction, so only the nozzle 54 will be described. Referring to FIG. 6, nozzle 54 has 1) a first, atomizing air inlet port 150, 2) a second, lubricant inlet port 152 coupled to a source of lubricant, 3) a pilot port 154, and 4) a lubricant/atomizing air discharge port 156. Air and lubricant are selectively supplied to the nozzle 54 by to the valve assembly 28 as detailed below.

The control stand 26 includes a base 142, a post 144 extending upwardly from the base 142, and a control board 146 on which are mounted the controller 30, and the valve assembly 28. The valve assembly 28 and controller 30 will now be detailed.

3. Construction of Control Valve Assembly

The control valve assembly 28 will now be described with reference to FIG. 6. The illustrated control valve assembly 28 is usable either with the lubricator 24 as already detailed or with other lubricator assemblies including the lubricator 224 of the second embodiment as described in Section 5 below. While each applicable valve of the valve assembly 28 is coupled to all three nozzles 54, 56, and 58 by conventional hoses, only a single nozzle 54 is illustrated for the sake of simplicity.

The control valve assembly 28 includes first through fourth valves 158, 160, 162 and 164 all of which are coupled to a common air source. The first valve 158 comprises a two-port/two-position electronically controlled solenoid valve having an outlet port 166 connected to the first, atomizing air port 150 of the metering nozzle 54 and having an inlet port 168 coupled to the air source by a pressure regulator 170 and suitable filters 172, 174. The first valve 158 is operable, upon energization or de-energization of its solenoid, to selectively and alternatively 1) couple the air source to the first or atomizing air inlet port 150 of the metering nozzle 54 and 2) isolate the air source from the first inlet port 150. The second valve 160 controls operation of the cylinder 60. The cylinder 60 could comprise a purely pneumatic cylinder in which case the valve 160 would be coupled directly to the cylinder. However, it is preferred that the cylinder 60 comprise a so-called air-over-oil cylinder in which the air pressure is converted to oil pressure before being transmitted to the cylinder 60 to provide smoother cylinder operation. A pair of air-over-oil actuators 176, 178 are therefore provided, each of which has an oil port 180, 182 and an air port 184, 186. The oil port 180, 182 of each actuator 176, 178 is coupled to a respective one of the cylinder or rod end 130 or 132 of the cylinder 60 by a flow-restricting check valve assembly 188, 190. The second valve 160 comprises a four-port/two-position solenoid valve having a first port 192 connected to the air source by a pressure regulator 194 and by the filters 172 and 174, a second port 196 connected to vent, and third and fourth ports 198 and 200 each of which is connected to the air port 184 or 186 of a respective air-over-oil actuator 176 or 178. The second valve 160 is operable, upon energization or deenergization of the solenoid thereof, to selectively and alternatively 1) pressurize the piston end 132 of the cylinder 60 while depressurizing the cylinder end 130, and 2) depressurize the piston end 132 of the cylinder 60 while depressurizing the cylinder end 130.

The third valve 162 comprises a three-port/two position solenoid valve having a first port 202 connected to the pilot port 154 of the metering nozzle 54 and second and third ports 204 and 206 connected to the air supply source and vent, respectively. The third valve 162 is operable, upon energization or de-energization of the solenoid thereof, to selectively and alternatively 1) couple the pilot air port 154 of the metering nozzle 54 to the source of pressurized air and 2) couple the pilot port 154 to vent.

The fourth valve 164 is optional, and is provided for supplying scale blow air to the front side of the die press 22 when the lubricator assembly 20 is not lubricating the dies 34 and 36. The fourth valve 164 has a first port 208 connected to the air source and a second port 210 connected to a nozzle (not shown) for blowing scale off the die press 22.

4. Construction of Control Circuitry and Operation of Lubricator Assembly

Figure 7:
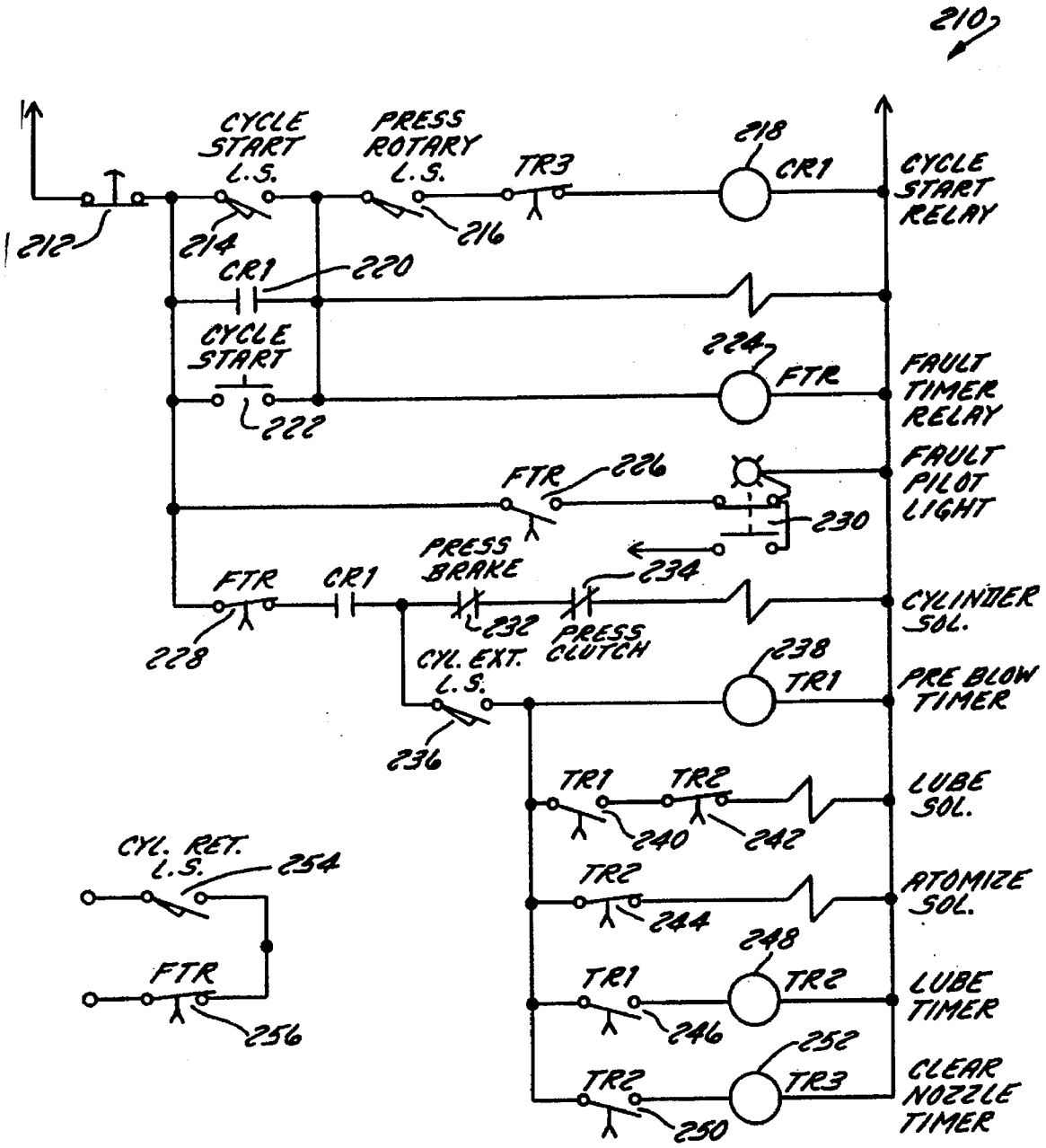
FIG. 7 is a ladder diagram of PLC circuitry of a controller usable to control operation of the lubricator assembly of FIGS. 1–5.
Figure 8:
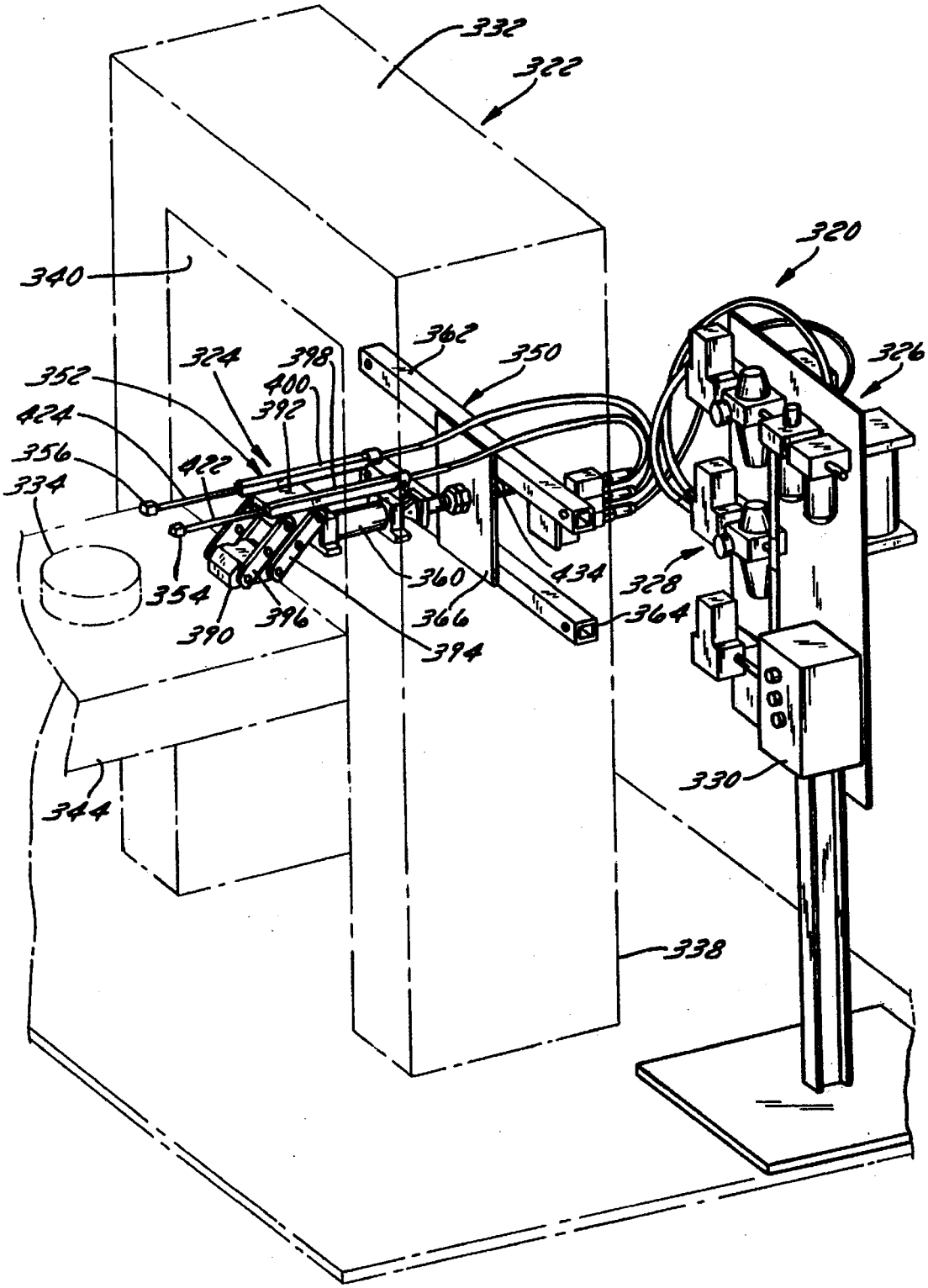
FIG. 8 is a perspective view of a lubricator assembly constructed in accordance with a second preferred embodiment of the invention and also schematically illustrating a die press with which the lubricator assembly is usable.
Figure 9:
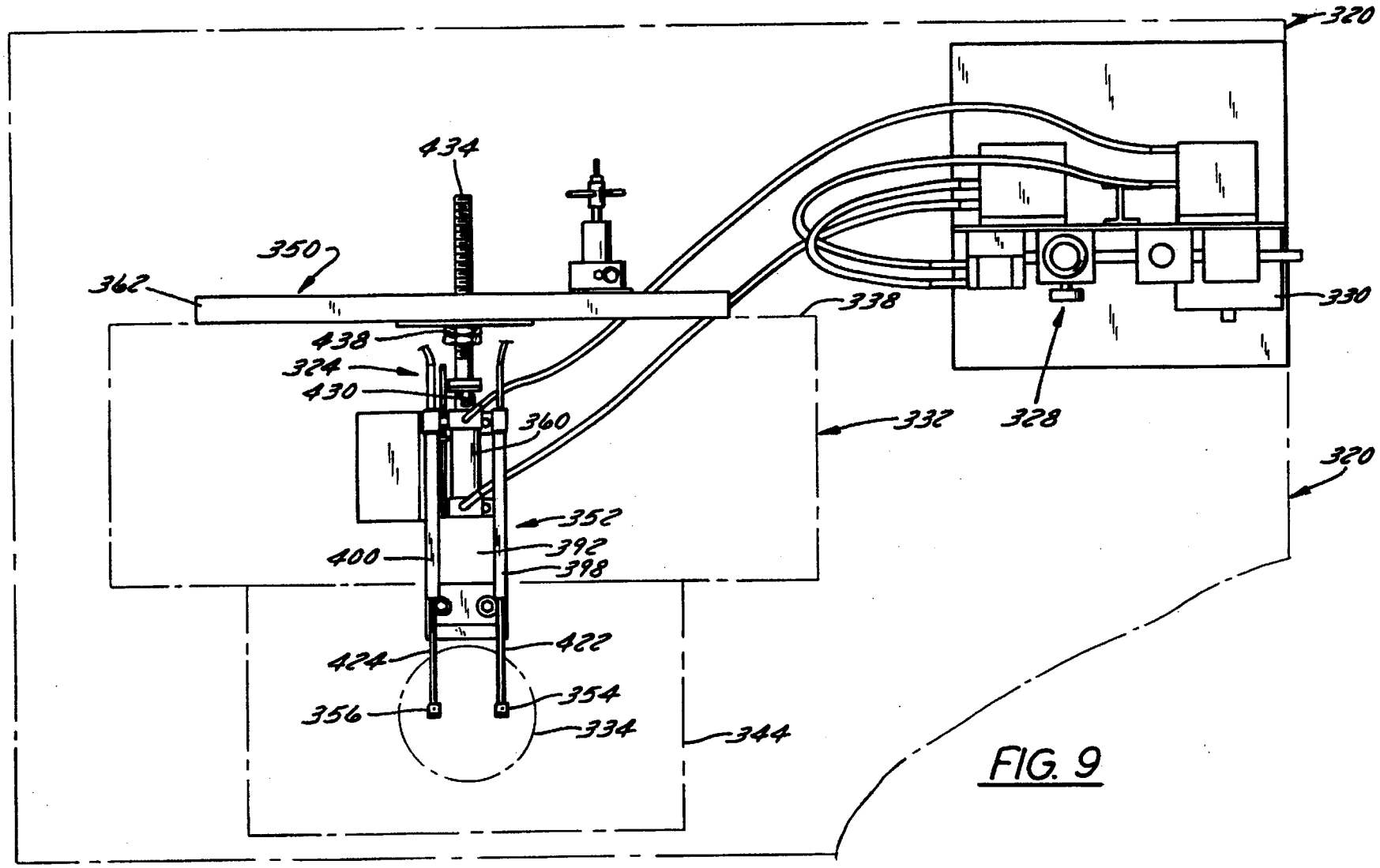
FIG. 9 is a top plan view of the lubricator assembly of FIG. 8, illustrating the lubricator in an extended position.

The controller 30 controls operation of the valve assembly 28 of FIG. 6 as well as some components of the die press 22. Referring now to FIG. 7, a ladder diagram 210 schematically illustrates PLC circuitry disposed in the controller 30 and usable with the valve assembly 28. The construction and operation of the circuitry illustrated in diagram 210 are believed to be self-explanatory from the drawings and, accordingly, will be discussed only briefly.

The first rung of the ladder diagram 210 includes an on-off switch 212, a cycle start limit switch 214, and a rotary press limit switch 216. The cycle start limit switch 214 is triggered when a casting or forging is ejected from the press cavity 40. Preferably, it is triggered directly by the forging via contact with the limit switch. The rotary press limit switch 216 ties into the press 22 to prevent extension of cylinder 60 unless the press 22 is in its uppermost position, thereby preventing the lubricator 24 from being crushed by the press 22. A cycle start relay 218 is energized only if all of these switches are closed.

Energization of the cycle start relay 218 disables the fourth solenoid valve 164 via the circuitry 220 of the second rung, and triggers a cycle start switch 222 in the third rung which in turn triggers a fault timer relay 224. The fault timer relay 224 ties operation of the lubricator 24 into operation of the press 22 to assure that the press 22 and lubricator 24 operate without interference from one another. The period of time set by the fault timer relay 224 must be greater than the period of the lube timer and clear nozzle timers detailed below. Normally open and normally closed fault relays 226 and 228, illustrated in the fourth and fifth rungs of the ladder diagram 10, control operation of a fault pilot light 230 and the press clutch and brake 232, 34. The normally closed fault relay 228 also prevents energization of the second or cylinder solenoid valve 160 when it is open, i.e., when there is a system fault.

Referring here to FIGS. 1–7, assuming that there is not a system fault and that the fault relay 228 is closed, energization of the cycle start relay 210 also causes energization of the second solenoid valve 160, forcing the cylinder 60 to extend. Cylinder extension pivots the swing arm assembly 52 from the position illustrated in FIGS. 3 and 4 in which the nozzles 54, 56, and 58 are positioned behind the dies 34 and 36 and below the top of the first die 34 to the position illustrated in FIG. 5 in which the nozzles 54, 56, and 58 are positioned approximately midway between the dies 34 and 36. In the illustrated embodiment, a mere 3" stroke of the cylinder 60 causes the nozzles 54, 56, and 58 to traverse a stroke of 10–12" (depending on the position of the I-bracket 140 on the support arms 92 and 94 and on the length of the lube arms 98, 100, 102) and preferably causes the nozzles 54, 56, and 58 to traverse a stroke of 10⅜" caused by an approximately 17.5° arcuate movement of the support arms 90, 92, 94, and 96. This arcuate movement is important not only to increase the stroke of the nozzles 54, 56, and 58 with a given stroke of the cylinder 60, but also to permit the tips of the nozzles to clear the bolster 32 and the die 34 as it swings into its operative position illustrated in FIG. 5.

Full extension of the cylinder 60 closes a limit switch 236 (FIG. 7). Normally open relays 240, 246, and 250 and normally closed relays 242 and 244 interact with timing relays 238, 248, and 252 to effect a three step operation. First, valve 158 is energized while valve 162 remains deenergized for a period determined by the pre-blow timer to eject straight air from the discharge port 156 of nozzle 54 for a brief period, thereby clearing the nozzle. Upon expiration of the pre-blow timing period, relay 246 closes to trigger a lube timing relay 248, and the first and third solenoid valves 158 and 162 are both energized for a period determined by the lube timer, typically about 0.10 seconds, to spray lubricant on the dies 34 and 36 as illustrated in FIG. 5. Upon expiration of the period set by the lube timer, relay 250 will close to energize timing relay 252 and de-energize the third solenoid valve 162 while energizing the first solenoid valve 158 for a designated period of time, typically about 0.15 seconds, to blow air only through the nozzles 54, 56, and 58 and clear the nozzles. Upon expiration of the period set by the clear nozzle timer, the first and third solenoid valves 158 and 162 will be de-energized, and the second solenoid valve 160 will be energized to retract the cylinder 60, thereby withdrawing the nozzles 54, 56, and 58 away from the dies 34 and 36. Full retraction of the cylinder 60 and hence termination of the lubricating cycle is detected by a cylinder retracted limit switch 254 which operates in conjunction with a normally closed fault timer relay 256 to assure that the lubrication cycle terminates before the next pressing sequence.

The control scheme discussed above is but one of many that could be used to control operation of the lubricator assembly and press. In addition, many changes could be made to the illustrated control scheme. For instance, the pre-blow and/or clear nozzle timing relays and associated timers could be eliminated to shorten the lubrication cycle.

The swing arm assembly 52 is a remarkably simple and effective mechanism to achieve rapid movement of a lubricating nozzle into and out of a press cavity with a very short cylinder stroke while assuring that the nozzles clear the bolster and the dies as they swing into the press cavity. The time required for a complete lubrication cycle, i.e., from initiation of cylinder extension to termination and cylinder retraction, is only about 1.5 seconds—a fraction of the time required for linearly reciprocating lubricator assemblies of comparable size.

The lubricator assembly 20 described above is well suited for use with relatively large die presses. However, different configurations might be desirable with different die presses. A glide arm assembly preferred with relatively small die presses will now be detailed.

5. Construction and Operation of Second Embodiment

Referring now to FIGS. 8–11, a lubricator assembly 320 constructed in accordance with a second preferred embodiment of the invention is illustrated. The lubricator assembly 320 is well suited for use with relatively small presses having 6" dies. The lubricator assembly 320 and the press 322 for which it is designed to be used are in many respects similar to the corresponding assemblies of the first embodiment. Indeed, the control stand 326, control valve assembly 328, and controller 330 are identical or virtually identical to the corresponding control stand 26, control valve assembly 28, and controller 30 of the first embodiment and will not be detailed.

Although smaller than the die press 22 of the first embodiment, the die press 322 of the second embodiment is quite similar to the die press 22 of the first embodiment and includes a bolster 332 having a rear surface 338 and lower and upper supports 334 and 336. Bolster 332 presents an opening 340 and a press cavity 342. Mounted in the press cavity 342 are a first, stationary die 334 and a second, movable die 336.

The lubricator assembly 320 includes a glide arm lubricator 324 which, like the swing arm lubricator 24 of the first embodiment, includes 1) a support frame 350 mountable on the bolster rear surface 338 behind the first and second dies 334 and 336, 2) a movable lubricating arm assembly 352, 3) lubricating nozzles 354, 356, and 4) an actuator 360. The support frame 350 includes a pair of vertically spaced, horizontal brackets 362, 364, and a support plate 366. The support brackets 362, 364 are bolted or otherwise affixed to the rear surface 338 of the bolster 332 on opposite sides of the opening 340. The support plate 336 is welded or otherwise affixed to the support brackets 362, 364 and receives a threaded support shaft 434 and lock nuts 438.

The lubricating arm assembly 352 takes the form of a glide arm assembly formed from a parallelogram linkage mechanism. Glide arm assembly 352 includes 1) a first bar 390 mounted on the bolster lower support 344 behind the first and second dies 334, 336, 2) a second bar 392 extending in parallel with and movable with respect to the first bar 390, 3) a third bar 394 having a first end pivotally attached to the first bar 390 and a second end pivotably attached to the second bar 392, and 4) a fourth bar 396 located in front of the third bar 394. The fourth bar 396 has a first end pivotably attached to the first bar 390 and a second end pivotably attached to the second bar 392. The actuator 360 comprises an air-over-oil pneumatic cylinder having a cylinder end 430 attached to the support rod 434 and a rod end 432 pivotably attached to the third bar 394 approximately midway between the first and second bars 390 and 392. A pair of tubular lube arms 398, 400 are mounted on top of the second bar 392. Each lube arm receives a supply tube 422, 424 having a metering nozzle 354, 356 mounted on the forward-most tip thereof. Pneumatic/hydraulic hose assemblies are connected to the supply tubes 422 and 424 as is conventional in the art. The dimensions of the various components of lubricator 324 will, of course, vary with the size of the die press 322. In the illustrated embodiment designed for use with 6" dies, the cylinder 360 has a maximum stroke of 3", the third and fourth bars 394 and 396 have a length of about 5.8", and the distance between the upper end of the third bar 394 and the nozzle tips is about 14", but can be adjusted from about 12" to about 16", depending upon the requirements of a particular press. The nozzles 354 and 356 in this configuration will traverse a stroke of about 6" with a 3" stroke of the cylinder 360.

Figure 10:
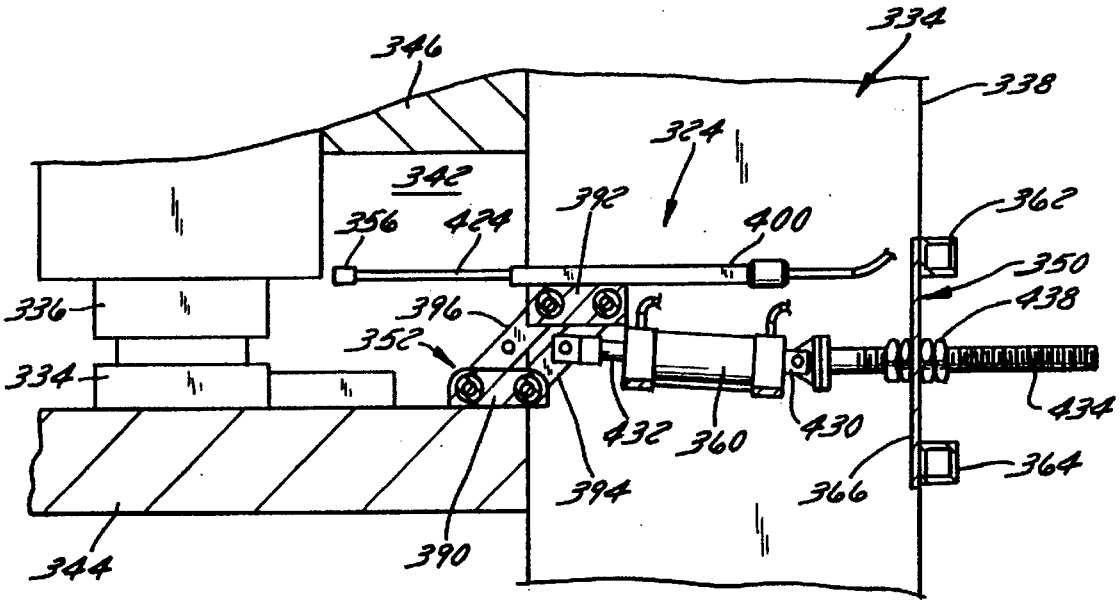
FIG. 10 is a sectional side elevation view of the lubricator of the assembly of FIGS. 8 and 9 and of corresponding portions of the die press and illustrates the lubricator in a retracted and non-lubricating position.
Figure 11:
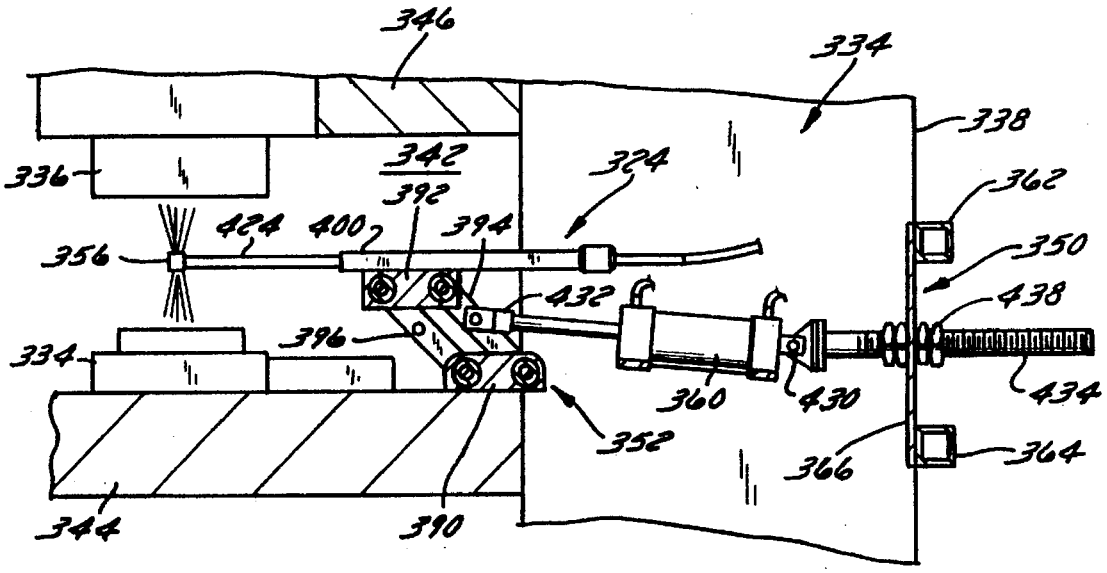
FIG. 11 corresponds to FIG. 10 and illustrates the lubricator in an extended and lubricating position.

In use, the cylinder 360 is retracted to withdraw the nozzles 354 and 356 away from the dies 334 and 336 during a pressing operation as illustrated in FIG. 10. Assuming that the same control scheme discussed above in connection with the first embodiment is used to control the lubricator 324, removing a workpiece from the press cavity 342 will trip a limit switch (not shown). Assuming that no fault conditions exists, triggering of the limit switch will result in energization of a solenoid valve to effect extension of the cylinder 360, thereby causing the nozzles 354 and 356 to traverse an arcuate path from the position illustrated in FIG. 10 in which they are located behind the dies 334 and 336 to that illustrated in FIG. 11 in which it they are located approximately midway between the dies 334 and 336. Termination of cylinder extension will trigger a limit switch (not shown) and effect a lube operation and a nozzle purge operation as detailed in Section 4 above, after which the cylinder 360 will again retract to return the nozzles 354 and 356 to the position illustrated in FIG. 10.

It should be noted that the embodiments described above are not necessarily mutually exclusive. For instance, the additional grooves 86 in the lower support bars 80 of the shaft holder 66 described above in connection with the first embodiment could receive a rod 434 of a lubricator 324 of the second embodiment thereby to support a second lubricator 324 on the first lubricator 24. Moreover, although the first bar 390 of the illustrated glide arm lubricator 324 is mounted on the lower support 344 of the bolster 332, it may in some instances be desirable or even necessary to invert the lubricator 324 such that the first bar 390 is located on the upper support 346 and the second bar 392 is located beneath the first bar 390. The scope of other changes which could be made without departing from the spirit of the invention will become apparent from the appended claims.

I claim:

1. A lubricator assembly for lubricating a die press usable in die forging, said die press including a bolster having a rear surface and an opening, and a die assembly mounted on said bolster within said opening, said die assembly including a first, stationary die and a second, movable die aligned with said first die, said lubricator assembly comprising:

(A) a support frame mountable on said bolster behind said first and second dies, said support frame including mounting plates attached to said rear surface of said bolster on either side of said opening;

(B) a movable lubricating arm assembly which is coupled to said support frame and at least a portion of which is movable toward and away from said dies, said lubricating arm assembly including a lube arm having a first end and having a second end;

(C) a lubricating nozzle supported on said second end of said lube arm; and (D) an actuator having a first end pivotally attached to said support frame and a second end pivotally attached to said lubricating arm assembly, wherein, upon extension of said actuator, said actuator drives said nozzle to move through an arc from a first position in which said nozzle is located behind said first and second dies to a second position in which said nozzle is positioned between said first and second dies, wherein said lubricating arm assembly comprises a swing arm assembly;

said support frame includes a swing arm support which is supported on and located between said mounting plates, said swing arm assembly is mounted on said swing arm support so as to be pivotable about a horizontal axis, said swing arm assembly including a) a support arm, said support arm extending downwardly from said swing arm support and having a first end supported on said swing arm support and having a second end, and b) a lube arm, said lube arm extending forwardly from said support arm and having a first end which is non-pivotally mounted on said second end of said support arm and a second end which supports said nozzle, said actuator comprises a cylinder having a first end pivotally attached to said support frame and a second end pivotally attached to said support arm at a location between said first and second ends thereof, and wherein upon extension of said cylinder, said nozzle swings upwards and forwards from a first position in which said nozzle is located behind said first and second dies and beneath an upper surface of said first die to a second position in which said nozzle is positioned vertically between said first and second dies.

2. A lubricator assembly as defined in claim 1, wherein said lube arm extends at an angle of approximately 80° from said support arm, wherein the shortest linear distance from said horizontal axis to said second end of said lube arm is over 36 inches, and wherein said cylinder has a maximum stroke of less than 6 inches.

3. A lubricator assembly as defined in claim 1, wherein said swing arm support comprises 1) braces which extend laterally inwardly from said support plates, and 2) a horizontal shaft holder which is mounted on said braces, said lubricating arm assembly further comprises 1) a shaft supported on said shaft holder, said support arm comprising a first support arm extending downwardly from said pivot shaft, 2) a second support arm which is spaced laterally from said first support arm, which has a first end attached to said shaft, and which has a second end, 3) a spray bar mounted on and extending laterally between said second ends of said first and second support arms, said lube arm comprising a first lube arm the first end which is attached to said spray arm, and 4) a second lube arm which is spaced laterally from said first lube arm, which has a first end attached to said spray arm, and which has a second end supporting a second nozzle.

4. A lubricator assembly as defined in claim 1, wherein said cylinder is attached to said support arm by an adjustable bracket which is movable longitudinally along said support arm thereby to adjust a stroke of said nozzle with a designated stroke of said cylinder.

5. A lubricator assembly as defined in claim 1, wherein said swing arm support includes a mounting device for supporting a second lubricating arm assembly.

6. A lubricator assembly as defined in claim 1, wherein said lube arm is tubular and said nozzle is mounted on a supply tube disposed at least partially within said lube arm.

7. A lubricator assembly as defined in claim 1, further comprising a control assembly for controlling operation of said actuator and said nozzle, said control assembly comprising a cycle start switch which triggers a cycle of said press;

means, responsive to said actuation of said cycle start switch, for extending said actuator to move said nozzle from said first position thereof to said second position thereof;

means for detecting movement of said nozzle into said second position from said first position;

means, responsive to said means for detecting, for actuating said nozzle to spray a lubricant onto said dies for a designated period; and means for retracting said actuator after expiration of said designated period, thereby moving said nozzle from said second position to said first position.

8. A lubricator assembly as defined in claim 2, wherein said nozzle traverses a stroke of over 10" with a 3" stroke of said cylinder.

9. A lubricator assembly as defined in claim 7, wherein said cycle start switch comprises a limit switch which is triggered when a workpiece is removed from said press, said means for actuating comprises a limit switch which is triggered upon full extension of said actuator, and wherein said designated period is set by a timer.

10. A lubricator assembly for lubricating a die press usable in die forging, said die press including a bolster having a rear surface and an opening, and a die assembly mounted on said bolster within said opening, said die assembly including a first, stationary die and a second, movable die aligned with said first die, said lubricator assembly comprising:

(A) a support frame mountable on said bolster behind said first and second dies, said support frame including mounting plates attached to said rear surface of said bolster on either side of said opening;

(B) a movable lubricating arm assembly which is coupled to said support frame and at least a portion of which is movable toward and away from said dies, said lubricating arm assembly including a lube arm having a first end and having a second end;

(C) a lubricating nozzle supported on said second end of said lube arm; and (D) an actuator having a first end pivotally attached to said support frame and a second end pivotally attached to said lubricating arm assembly, wherein, upon extension of said actuator, said nozzle moves through an arc from a first position in which said nozzle is located behind said first and second dies to a second position in which said nozzle is positioned between said first and second dies, wherein said nozzle comprises a pilot actuated metering nozzle having an atomizing air inlet port, a second lubricant inlet port, a pilot port, and an outlet port, and wherein said actuator comprises a double acting pneumatic cylinder having a cylinder-side port and a piston-side port, and further comprising a source of pressurized air; and a valve assembly for effecting operation of said cylinder and said nozzle, said valve assembly comprising a first, two-port/two position solenoid valve selectively and alternatively 1) coupling said source of pressurized air to said atomizing air inlet port of said metering nozzle and 2) isolating said source of pressurized air from said atomizing air inlet port of said metering nozzle, a second, four-port/two position solenoid valve operatively connected to said source of pressurized air, said cylinder, and vent, said second valve selectively and alternatively 1) pressurizing said piston-side port of said cylinder while depressurizing said cylinder-side port of said cylinder, and 2) depressurizing said piston-side port of said cylinder while pressurizing said cylinder-side port of said cylinder, and a third, three-port/two position solenoid valve connected to said source of pressurized air, said pilot port of said metering nozzle, and vent, said third valve selectively and alternatively 1) coupling said second inlet port of said metering nozzle to said source of pressurized air and 2) coupling said second port of said metering nozzle to vent.

11. A lubricator assembly for lubricating dies of a die press usable in forging, said die press including 1) a bolster having a rear surface and an opening, and 2) a die assembly mounted on said bolster within said opening, said die assembly including a first, upwardly-facing stationary die and a second, downwardly-facing vertically movable die, said lubricator assembly comprising:

(A) a support frame mountable on said rear surface of said bolster, said support frame including a) mounting plates attached to said rear surface of said bolster on either side of said opening and b) a swing arm support which is supported on said support frame and which is located between said mounting plates;

(B) a swing arm assembly which is mounted on said swing arm support so as to be pivotable about a horizontal axis, said swing arm assembly including a) a support arm extending downwardly from said swing arm support, said support arm having a first end supported on said swing arm support and having a second end, and b) a lube arm extending forwardly from said second end of said support arm, said lube arm having a first end nonpivotally attached to said second end of said support arm and having a second end;

(C) a lubricating nozzle supported on said second end of said lube arm, and (D) a fluid pressure cylinder having a first end pivotally attached to said support frame and a second end pivotally attached to said support arm at a location between said first and second ends thereof, wherein, upon extension of said cylinder, said cylinder drives said nozzle to move from a first position in which said nozzle is located behind said first and second dies and beneath an upper surface of said first die to a second position in which said nozzle is positioned vertically between said first and second dies.

12. A lubricator assembly as defined in claim 11, wherein said swing arm support comprises 1) braces which extend laterally inwardly from said support plates, and 2) a horizontal shaft holder which is mounted on said braces, said swing arm assembly includes 1) a pivot shaft rotatably supported on said shaft holder, said support arm comprising a first support arm extending downwardly from said pivot shaft, 2) a second support arm which is spaced laterally from said first support arm, which has a first end attached to said pivot shaft, and which has a second end, 3) a spray arm mounted on and extending laterally between said second ends of said first and second support arms, said lube arm comprising a first lube arm the first end which is attached to said spray arm, and 4) a second lube arm which is spaced laterally from said first lube arm, which has a first end attached to said spray arm, and which has a second end supporting a second lubricating nozzle.

13. A lubricator assembly for lubricating a press usable in die forging, said press including 1) a bolster having a rear surface and an opening bordered vertically by an upper support and a lower support, and 2) a die assembly mounted on said bolster within said opening, said die assembly including a first, stationary die extending upwardly from said lower Support and a second, movable die aligned with said first die and extending downwardly from said upper support, said lubricator assembly comprising:

(A) a support frame mountable on said bolster behind said dies, said support frame including mounting plates attached to said rear surface of said bolster on either side of said opening;

(B) a glide arm assembly which is coupled to said support frame and at least a portion of which is movable toward and away from said dies, said glide arm assembly including (1) a first horizontal bar fixedly mounted on said lower support of said bolster behind said first and second dies, (2) a second horizontal bar extending in parallel with said first bar and being spaced vertically from said second die and said upper support of said bolster, (3) a third bar having a first end pivotally attached to said first bar and a second end pivotally attached to said second bar, and (4) a lube arm fixed onto said second bar so as to remain substantially parallel with said second bar, said lube arm having a first end mounted on said second bar and having a second end located in front of said second bar;

(C) a nozzle supported on said second end of said lube arm; and (D) a fluid pressure cylinder having a first end pivotally attached to said support frame and a second end pivotally attached to said third arm of said glide arm assembly, wherein, upon extension of said cylinder, said cylinder drives said nozzle to move through an am from a first position in which said nozzle is located behind said first and second dies to a second position in which said nozzle is positioned between said first and second dies.

14. A lubricator assembly as defined in claim 13, wherein said nozzle traverses a stroke of approximately 5.5" to 7.0", and wherein said cylinder has a maximum stroke of less than 6 inches.

15. A lubricator assembly as defined in claim 13, wherein said glide arm assembly comprises a parallelogram linkage mechanism which further includes a fourth bar which extends in parallel with said third bar and which is located in front of said third bar, said fourth bar having a first end pivotally attached to said first bar and a second end pivotally attached to said second bar.

16. A lubricator assembly as defined in claim 14, wherein said nozzle traverses a stroke of about 6.1", and wherein said cylinder has a maximum stroke of about 3 inches.

* * * * *